United States Patent [19]

Brunnert

[11] Patent Number: 5,040,833

[45] Date of Patent: Aug. 20, 1991

[54] CLOSING DEVICE FOR DRAWERS

[75] Inventor: Eberhard Brunnert, Elchingen, Fed. Rep. of Germany

[73] Assignee: Julius Blum Gesellschaft m.b.H., Höchst, Austria

[21] Appl. No.: 517,038

[22] Filed: May 1, 1990

[30] Foreign Application Priority Data

May 10, 1989 [AT] Austria ..... 1108/89

[51] Int. Cl.[5] ..... F05C 19/02

[52] U.S. Cl. ..... 292/80; 292/DIG. 4

[58] Field of Search ..... 292/DIG. 4, 152, 80, 292/92

[56] References Cited

U.S. PATENT DOCUMENTS

| | | | |
|---|---|---|---|
| 1,493,794 | 5/1924 | Robertson | 292/DIG. 4 |
| 3,156,493 | 11/1964 | Griffiths | 292/DIG. 4 |
| 3,189,374 | 6/1965 | Mertes | 292/80 |
| 3,694,015 | 9/1972 | Gley | 292/80 |
| 3,785,004 | 1/1974 | Stoffregen | 292/DIG. 4 |
| 3,854.784 | 12/1974 | Hunt et al. | 292/DIG. 4 |
| 3,854,785 | 12/1974 | Manner et al. | 292/DIG. 4 |
| 4,657,292 | 4/1987 | Bruck | 292/DIG. 4 |
| 4,669,764 | 6/1987 | Bruck | 292/DIG. 4 |

FOREIGN PATENT DOCUMENTS 3300926 11/1986 Fed. Rep. of Germany .

*Primary Examiner*—Eric H. Nicholson

*Attorney, Agent, or Firm*—Wenderoth, Lind & Ponack

[57] ABSTRACT

A closing device for a drawer includes a holding part in the form of a hook, a latch part and a spring tensioning such two parts to an engaged position. The holding part is, for example, fastened to a furniture body and the latch part to the drawer. The latch part has at least two different guide tracks for guiding the holding part, the holding part being guided along different guide tracks during opening and closing of the drawer. The holding part is bendable laterally as well as in the plane of the hook. When a tensioning force acts on a closed drawer, the holding part evades the latch part by bending in the plane of the hook.

23 Claims, 15 Drawing Sheets

4
7
31

4
10
26
29
30
13
9'
12
9
31

13
9'
12

CLOSING DEVICE FOR DRAWERS

FIELD AND BACKGROUND OF THE INVENTION

The present invention relates to a closing device for a drawer and includes a holding part, a latch part and a spring tensioning such two parts into an engaged position. For example, the holding part is fastened to a furniture body and the latch part to a drawer. The latch part having at least two different guide tracks for guiding the holding part, and the holding part is guided along different guide tracks during opening and closing of the drawer. The holding part engages in a notch of the latch part in the closed position of the drawer.

Conventional closing devices effect only closing of a drawer when the drawer has been pushed into the furniture body. The closing device can be opened by means of a key or direct actuation of the lock member, for example via a press button system.

SUMMARY OF THE INVENTION

It is the object of the invention to provide an improved closing device by means of which a drawer is allowed to be guided by rollers or bearings and is opened by slight pressure against the front plate of the drawer without the necessity of having to pull the drawer outwardly.

The advantage of a closing device of the aforementioned type is that it provides increased operating convenience, particularly when employed in kitchen furniture.

A storing container which has the above-mentioned features is known from DE-Al-33 00 926. It is a disadvantage of this construction that the container can be opened only by exerting pressure thereon. This is rather unusual with kitchen furniture. It may therefore happen that a drawer which is provided with a mechanism of this type is torn out from the furniture body by careless handling.

The improvement according to the invention guarantees that the closing device is not damaged in case of such careless handling.

According to the invention this is achieved in that the latch part has at least one raised area the contour of which forms the guide tracks, and that the holding part is formed by a hook which is bendable laterally and in the plane of the hook. The bendability of the hook in the plate of the hook does not become effective during normal operation of the drawer and of the closing device. Such bending becomes effective, however, when the drawer is pulled out from the body because of careless handling. The hook is then guided over the raised area or areas of the latch part and damage to the closing device is avoided.

As already mentioned, the closing device includes a spring which is tensioned when the drawer is being closed, and a locking mechanism which is formed by the holding part and the latch part and forms a switching mechanism which alternately locks and opens, since closing of the drawer as well as initiation of the opening process takes place in the same direction, namely in the push-in direction of the drawer.

It is advantageously provided that the hook forming the holding part is laterally bendable. It is further advantageously provided that the latch part has at least one raised area the contour of which forms the guide tracks. The hook forming the hold part is guided along the contour of the raised area and bent thereby. When such guiding ceases, the hook returns to a center position thereof due to its own elasticity and engages in the latch part in such position.

Advantageously, the latch part has two raised areas which are arranged behind each other in the direction of displacement, and the raised area or one of the two raised areas has a notch in which the holding part engages in the closed position of the drawer. In such arrangement, the front raised area serves to urge the hook outwardly from the center position and guide it laterally past the rear raised area.

One embodiment of the invention provides that the front raised area is triangular when viewed from the top, one vertex of the triangle being directed towards the rear raised area.

A further embodiment of the invention provides that the spring is fastened to the furniture body and has a catch member, for example a ring or a plate, for a driving member of the drawer.

To ensure that little force is necessary for opening the closing device, a further embodiment provides that the spring presses on a pivot member which is mounted on the same furniture part on which is mounted the spring and has a curved control member by means of which the pivot member abuts, when the drawer is in the closed position, on a counter curved surface which is mounted on the other furniture part. The spring and the pivot member can be mounted in a drawer side wall for example, and the counter curved surface can be formed on a stop member which is fastened to the furniture body. Advantageously, the stop member and the hook forming the holding part are formed as an integral piece.

BRIEF DESCRIPTION OF THE DRAWINGS

The following embodiments of the invention will be described in more detail with reference to the accompanying drawings, without being limited thereto, and wherein.

Figures 8, 9A, 9B:
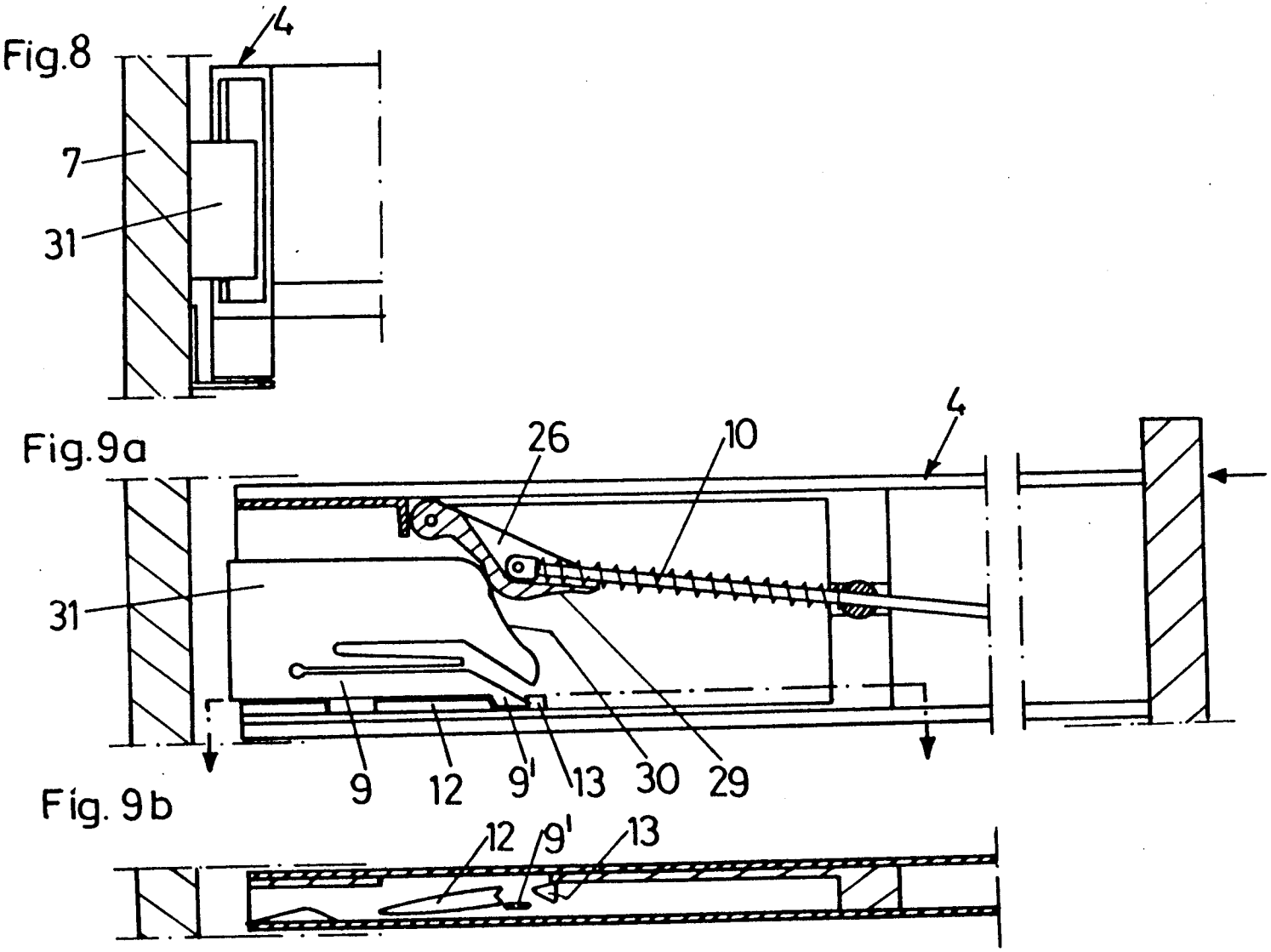
Figure 16:
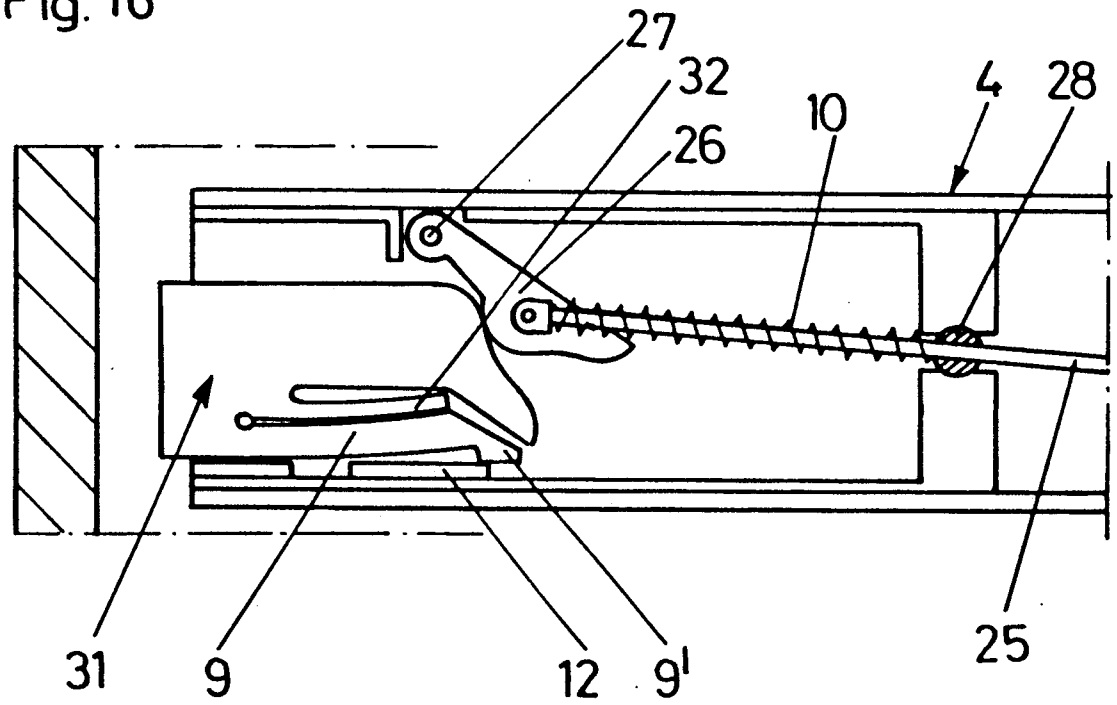
Figure 17:
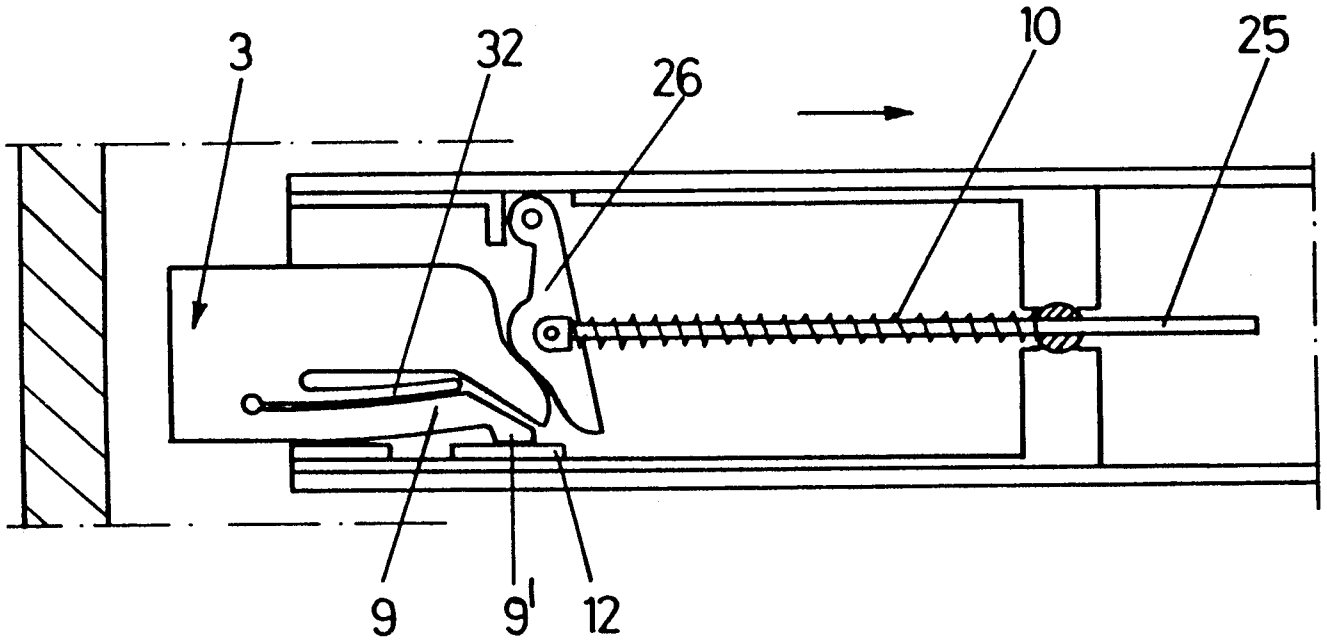
Figure 18A:
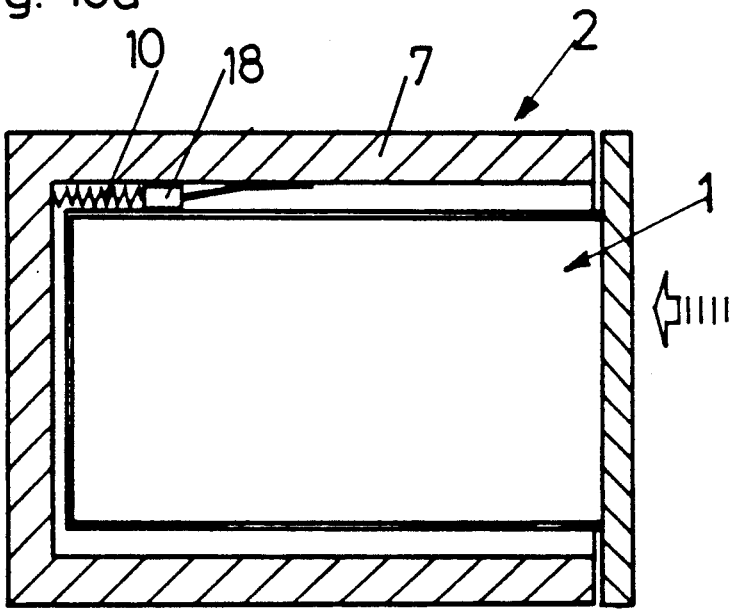
Figure 18B:
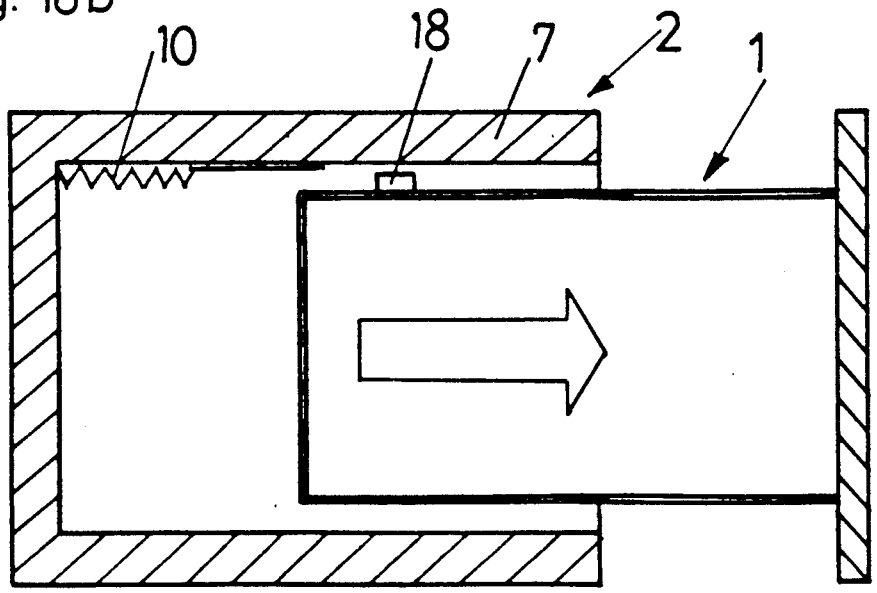

FIG. *7a* and *7b* are respectively a vertical sectional view and a horizontal sectional view of a drawer side wall in a further embodiment of the invention;

FIG. 8 is a rear view, partially in section, of a body side wall and a drawer side wall;

FIGS. 9*a* to 15*a* are horizontal and vertical sectional views of a drawer side wall, with a closing device being shown in a different positions in which it is engaged;

FIGS. 16 and 17 are vertical sectional views of a drawer side wall, wherein evasion, of the holding part is shown; and FIGS. 18*a* to 20*a* are schematic views of different arrangements of a spring.

DESCRIPTION OF THE PREFERRED EMBODIMENTS

Figure 1:
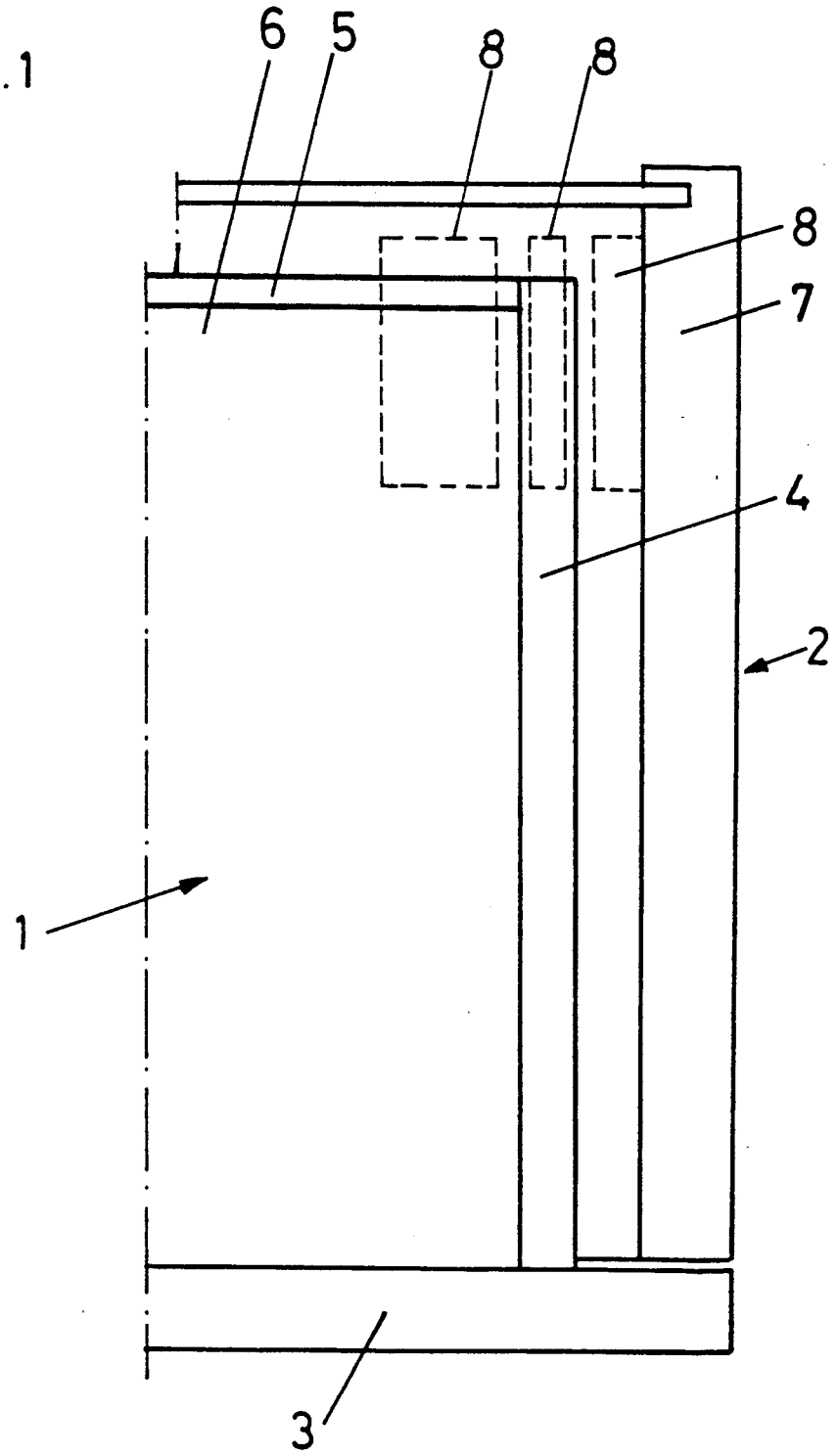
FIG. 1 is a schematic top view of a furniture body and a drawer, a top plate of the article of furniture not being shown.

In FIG. 1, a drawer in its entirety is designated by reference number 1 and a furniture body by reference number 2. The drawer has a front plate 3, a double-walled side wall 4, for example of extruded aluminum, on each side of a rear wall 5, as well as a bottom 6. A side wall of the furniture body is designated by reference 7.

A closing device 8 is indicated in FIG. 1 by dotted lines and can be arranged between the furniture body 2 and the drawer 1 below the drawer bottom 6, in the drawer side wall 4 or in the space between the drawer side wall 4 and the body side wall 7. The actual elements of the closing device 8 include only a holding part or member 9 and a latch part or member 11. A spring 10 (to be discussed below) can, independently of parts 9 and 11, be fastened at a different portion of the drawer.

Figure 2:
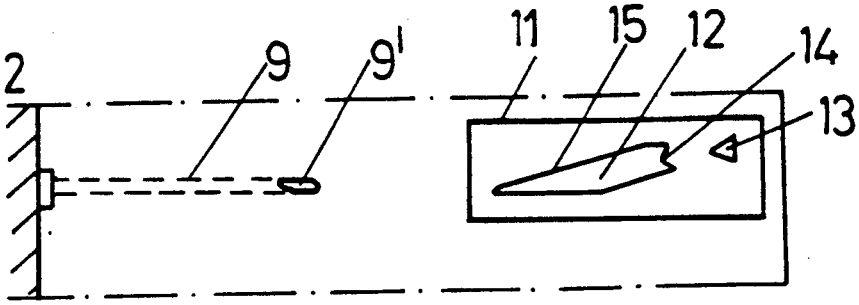
FIG. 2 to 6 are diagrammatic views of a closing device according to the invention shown in different positions in which it is engaged or being engaged.

The holding part 9 is, as can be seen from FIG. 2, hook-shaped and is bendable in two directions, ie. sideways and in the plane of a hook formed by a hook-shaped free end 9.

The latch part 11 is a plate-shaped structure with two raised areas 12, 13. The raised area 12 has a notch 14 in which engages free hook-shaped end 9' of holding part 9 when the drawer 1 is closed. The contours of the raised areas 12, 13 form guide tracks for the holding part 9.

Figure 3:
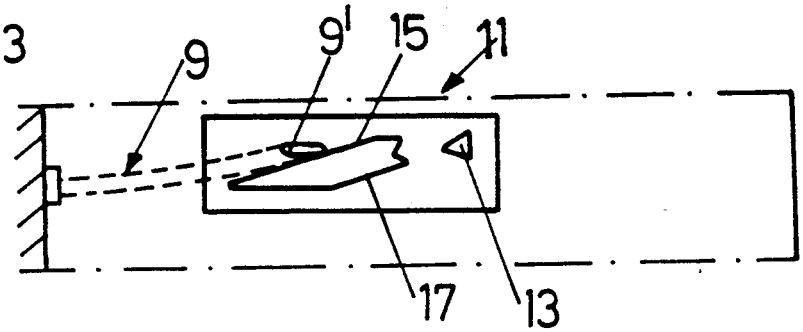
Figure 4:
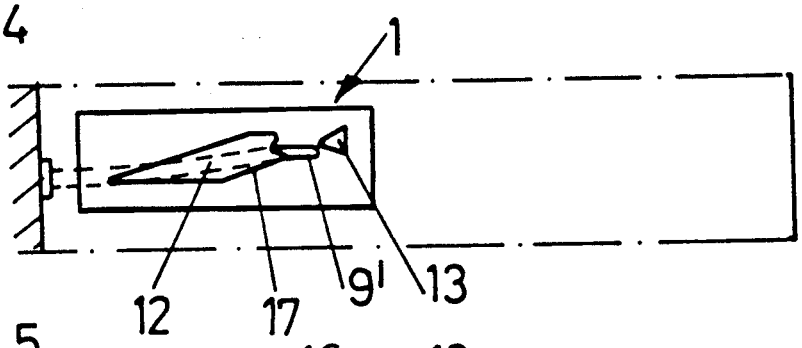

The raised area 12 has an inclined guide track 15 along which the holding part 9 is guided when the drawer 1 is being closed (see FIG. 3). The holding part 9 is bent laterally by the raised area 12 and the guide track 15. As soon as the raised area 12 is behind the front end 9' of the holding part, the elasticity of holding part 9 tends to return it toward a normal, central position, and hook-shaped end 9' engages in the notch 14 of the raised area 12. The drawer 1 is thus locked in a closed position, and the closing device is in an engaged position (FIG. 4).

Figure 5:
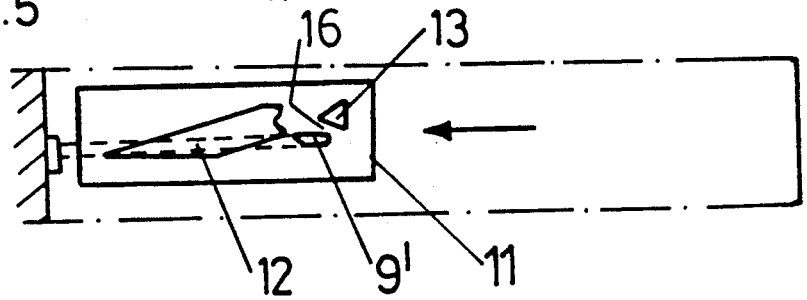
Figure 6:
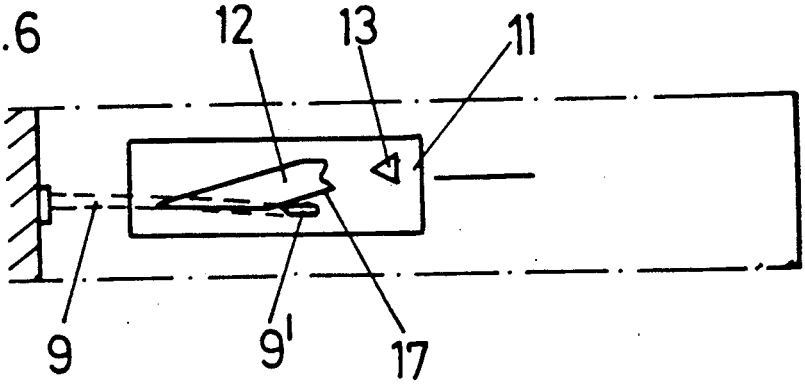

When rearward pressure is exerted on the front plate 3 of the drawer 1, the drawer 1 and thus the latch part 11 is further pushed into the furniture body in the direction of the arrow of FIG. 5. The free end 9' of the holding part 9 reaches the raised area 13 and is pressed against a flank thereof which forms a guide track 16. The free hook-shaped end 9' of holding part 9 is moved by guide track 16 out of alignment with the notch 14. Upon forward movement of the drawer, the holding part 9 then is guided along a guide track 17 of the raised area 12, thus releasing the latch part 11 from engagement with holding part 9. The drawer 1 is pressed or drawn outwardly by means of the force of spring 10. In the illustrated embodiment the holding part 9 is fastened to the furniture body and the latch part 11 to the drawer 1. Obviously, the mounting of these two parts could be reversed.

As already mentioned, the spring 10 can be mounted at the drawer independently of the holding part 9 and the latch part 11. In the embodiment according to FIGS. 18*a* and 18*b* the spring 10 is mounted at the side wall 7 or at the rear wall of the piece of furniture, and the drawer 1 is laterally provided with a stop member 18 which compresses the spring 10 when the drawer 1 is pushed into the furniture body 2.

Figure 19A:
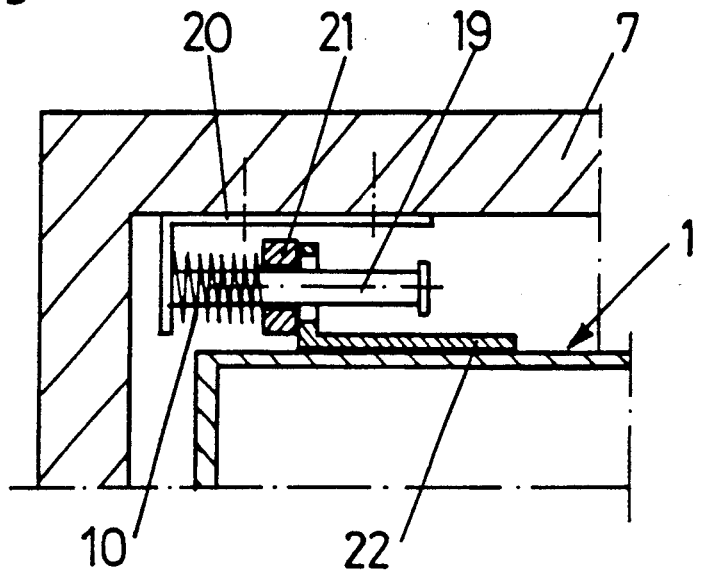
Figure 19B:
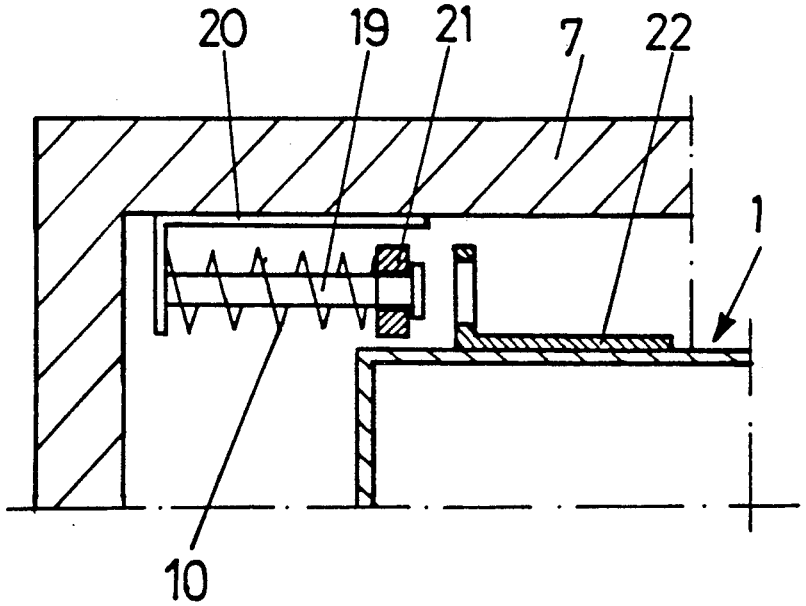

In the embodiment according to FIGS. 19*a* and 19*b* the spring 10 is mounted on a pin which is fastened on a bracket 20 attached to the body side wall 7. The spring 10 carries a ring 21 against which abuts a stop member 22 fastened to the drawer 1. When the drawer 1 is closed, the spring 10, which is a pressure spring, is compressed by the stop member 22.

Figure 20A:
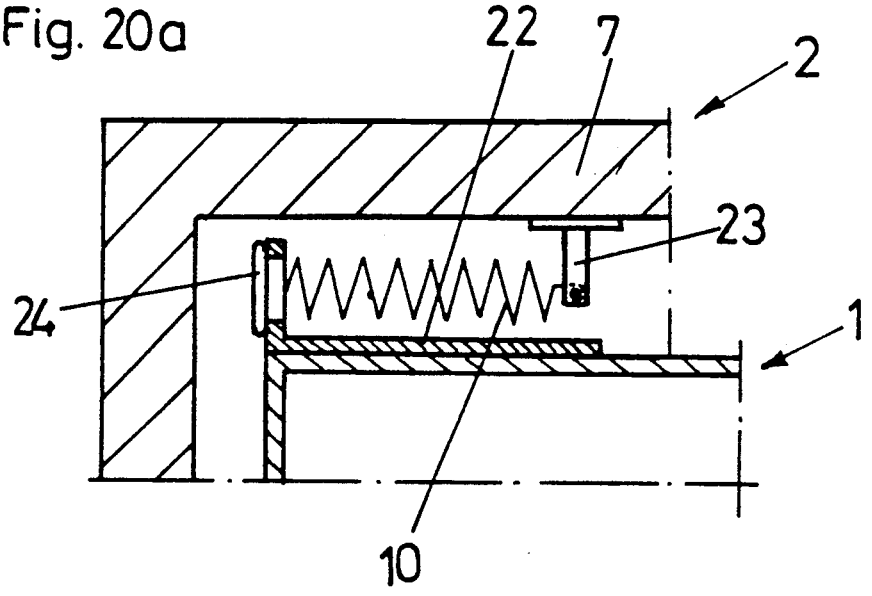
Figure 20B:
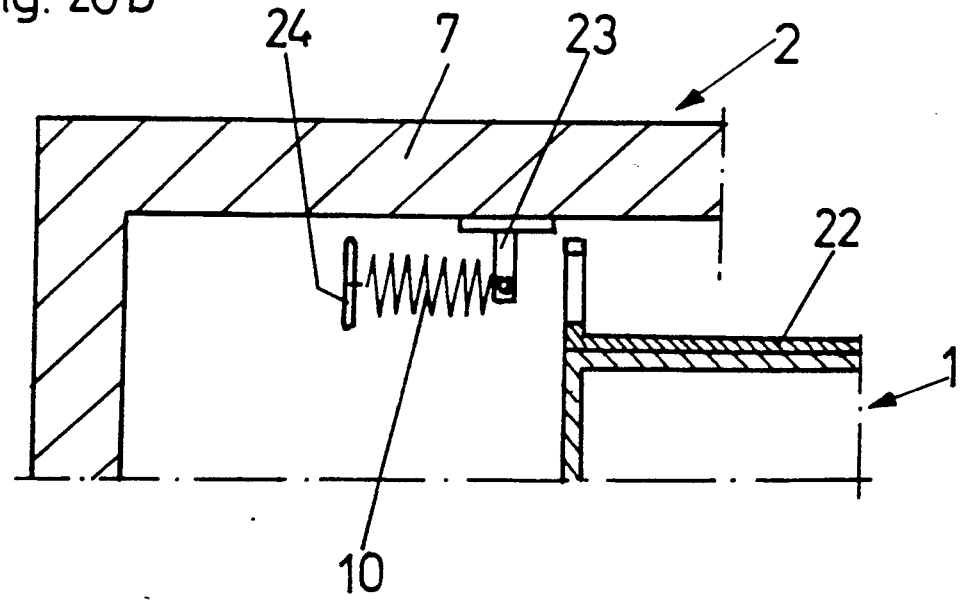

FIGS. 20*a* and *b* show a variant in which the spring 10 is a tension spring. The spring 10 is fastened to the body side wall 7 by means of a holding member 23. At its free end, the spring 10 is provided with a plate 24. The stop member 22 which is fastened to the drawer 1 abuts the plate 24 and expands the spring 10 when the drawer is being closed.

As already mentioned, it is a disadvantage of the afore-described embodiment that the spring 10 exerts a great force in the tensioned condition and thus highly stresses the switching contour of the latch part 11. This disadvantage is eliminated in the embodiment of FIGS. 7*a* and 7*b*. The spring 10 is located inside the drawer side wall 4 and is mounted on a pivot bar 25. The pivot bar 25 is hingedly connected with a pivot member 26 that is rotatably mounted about a bearing point 27 of the drawer wall 4. The bar 25 is displaceably axially thereof within a bearing 28 supported in the drawer side wall 4. The spring 10 presses against bearing 28 as well as against pivot member 26 and thus presses the pivot member 26 towards the rear. A curved control member 229 integral with the pivot member 26 an abuts against a counter curved surface 30 under the force of spring 10. The curved surface 30 is formed on a leaf-shaped stop member 31 fixed to the furniture body and which is formed integrally with the holding part 9.

Figure 7A:
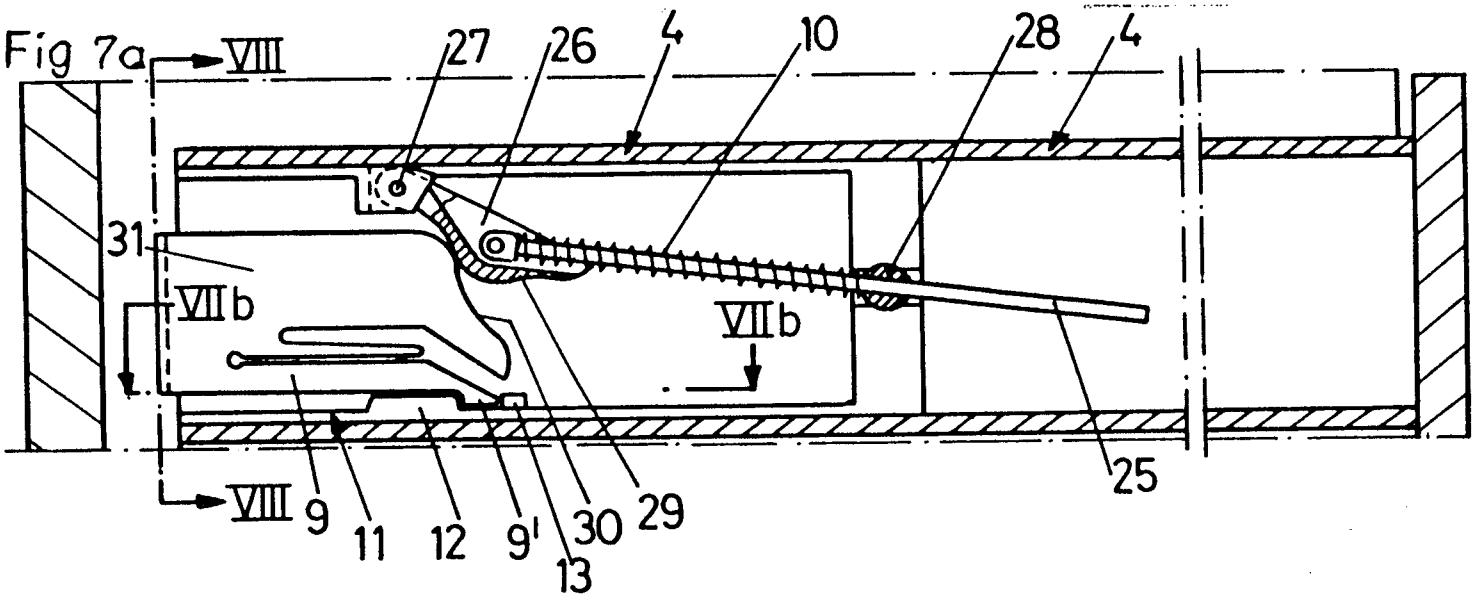
Figure 7B:
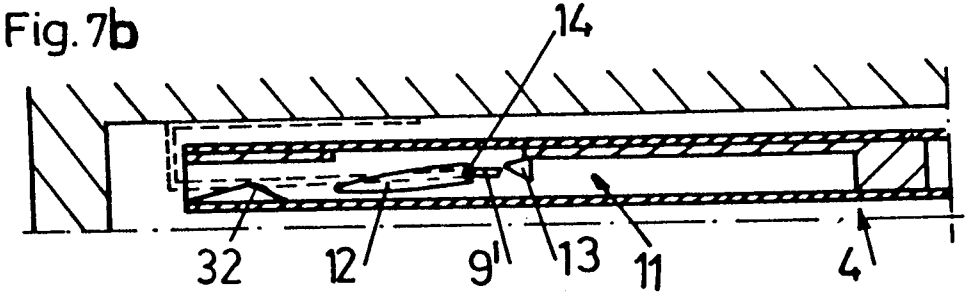

In FIGS. 7*a* and 7*b* the drawer 1 is shown in the pushed-in position. The spring 10 is compressed and presses the pivot member 26 such that member 29 abuts on the surface 30 of the stop member 31. The holding part 9 engages with its free and 9' in notch 14 of the raised area 12.

As can be seen from FIGS. 9*a* and 9*b*, rearward pressure on the front plate 3 causes the free end 9' of the holding part 9 to disengage from the notch 14 and the holding part is then to be pressed towards the side by the raised area 13.

Figures 10A, 10B:
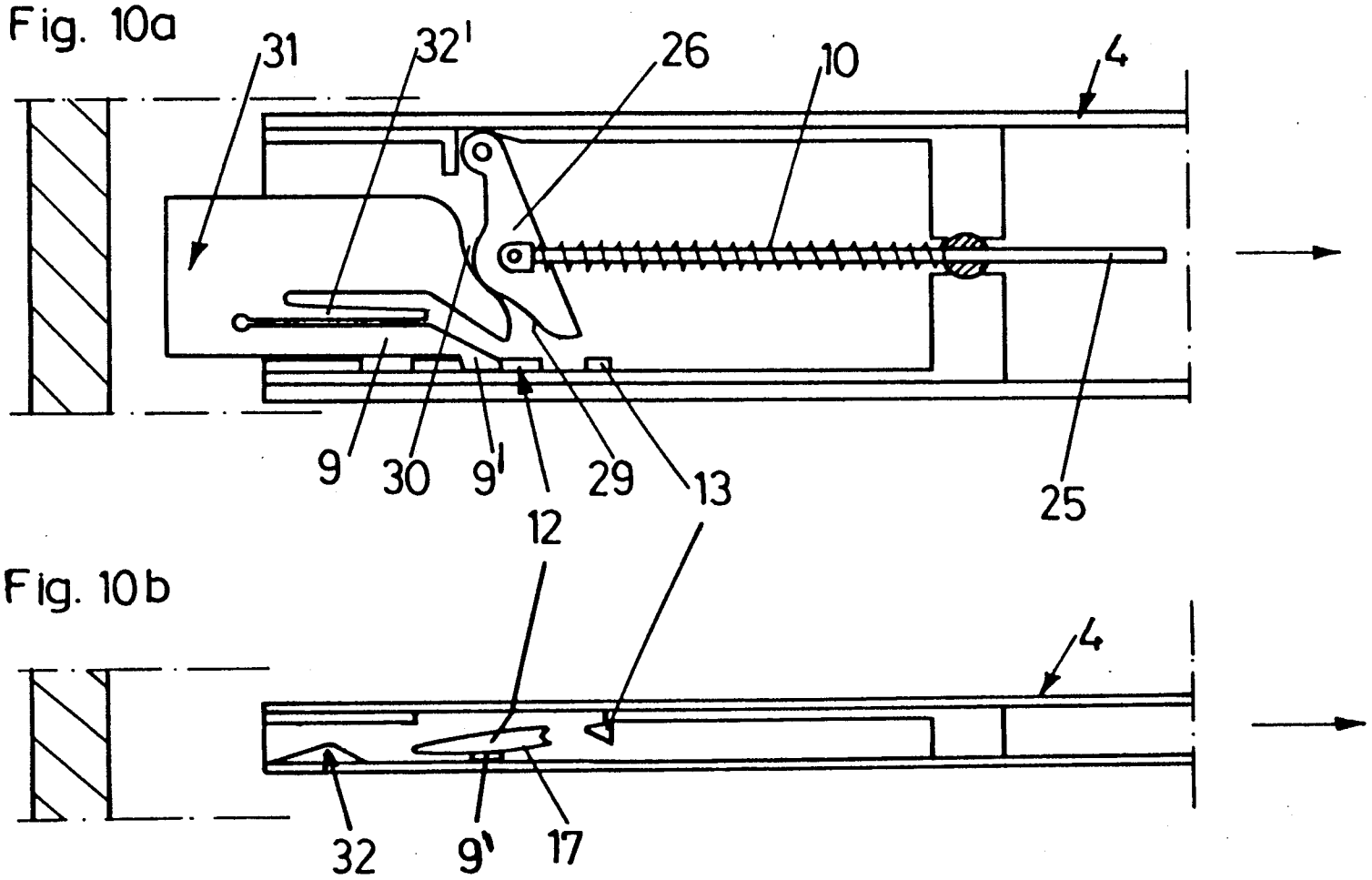

As can be seen from FIGS. 10*a* and 10*b*, the spring 10 then presses the drawer 1 outwardly and the hook-shaped free end 9' of the holding part 9 slides along the guide track 17 formed by the flank of the raised area 12 as the drawer and the latch part 11 move forwardly.

Figure 11A:
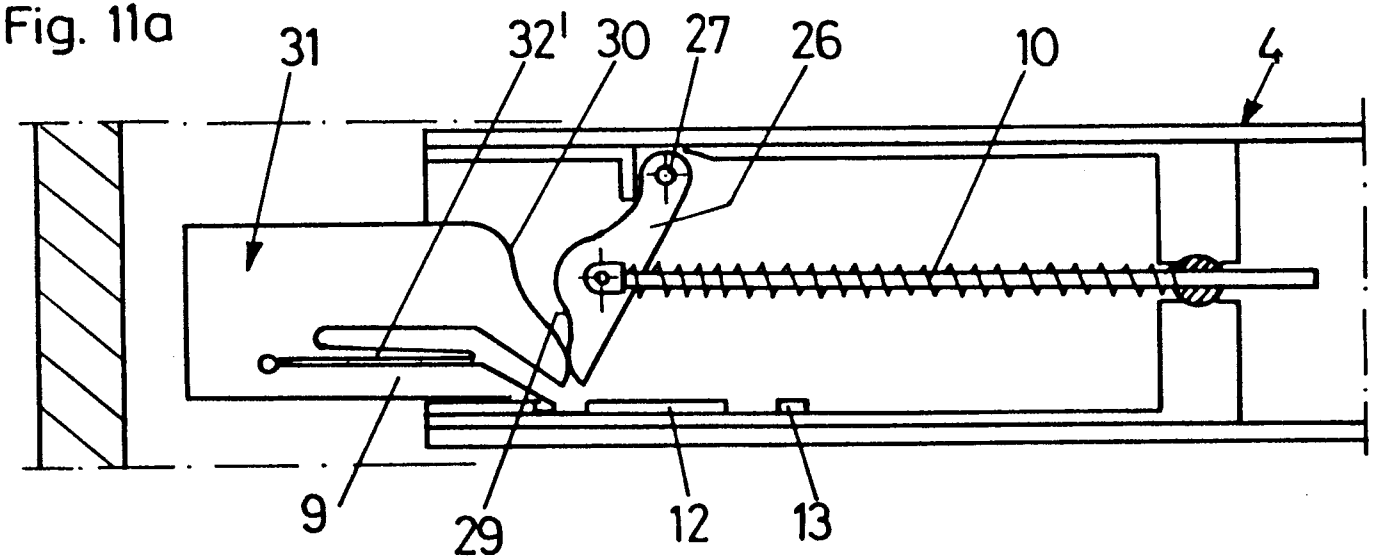
Figure 11B:
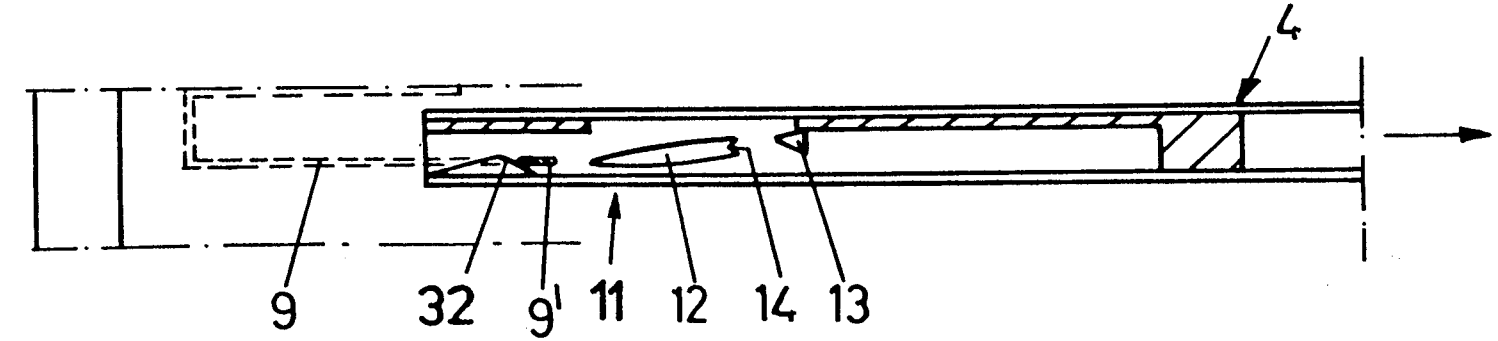

FIGS. 11*a* and 11*b* show the extreme position of cooperation of parts 9 and 11 of the closing device. By means of a further raised area 32, the hook member 9 is guided again to its initial position, ie. with a straightened orientation.

Figure 12A:
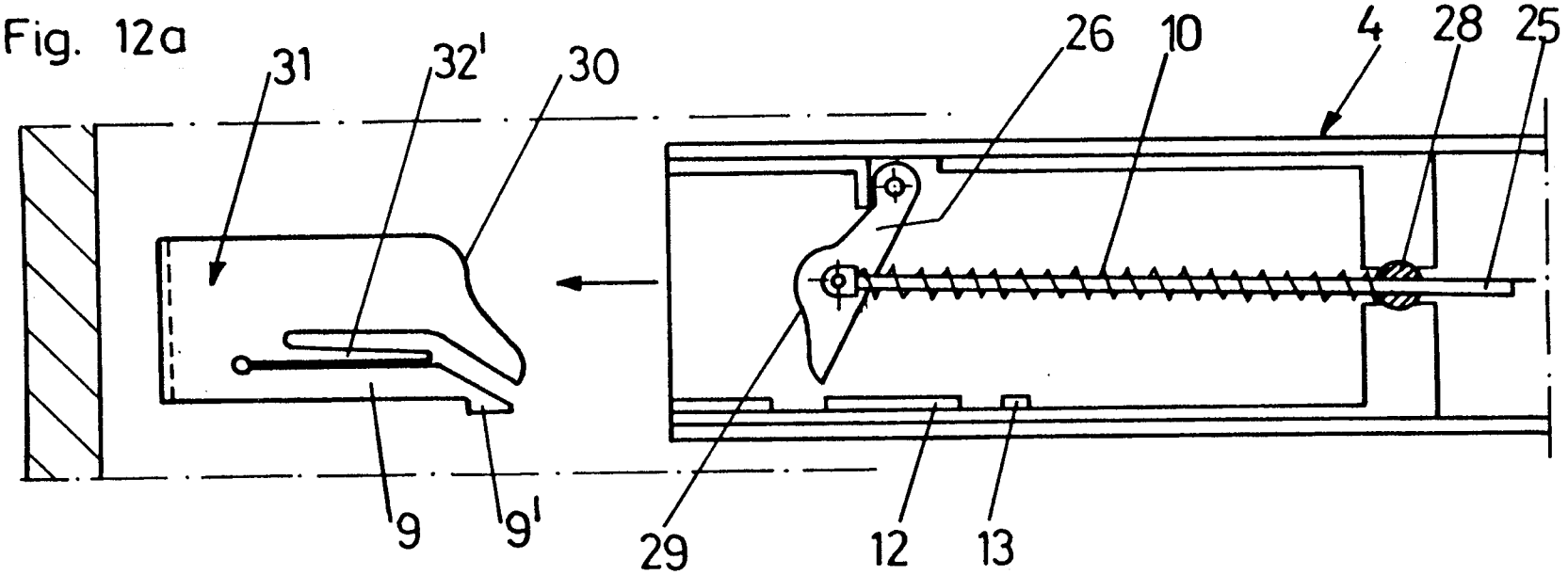
Figure 12B:
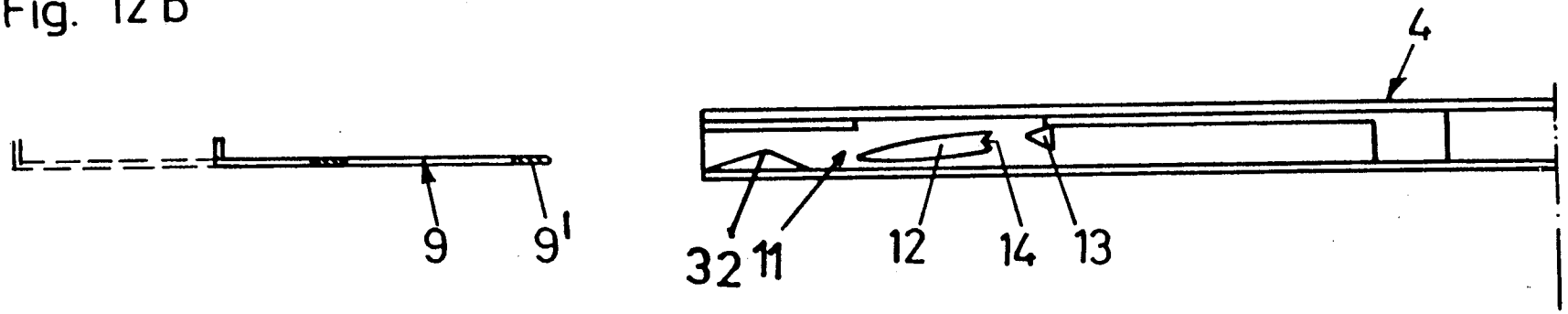
Figure 13A:
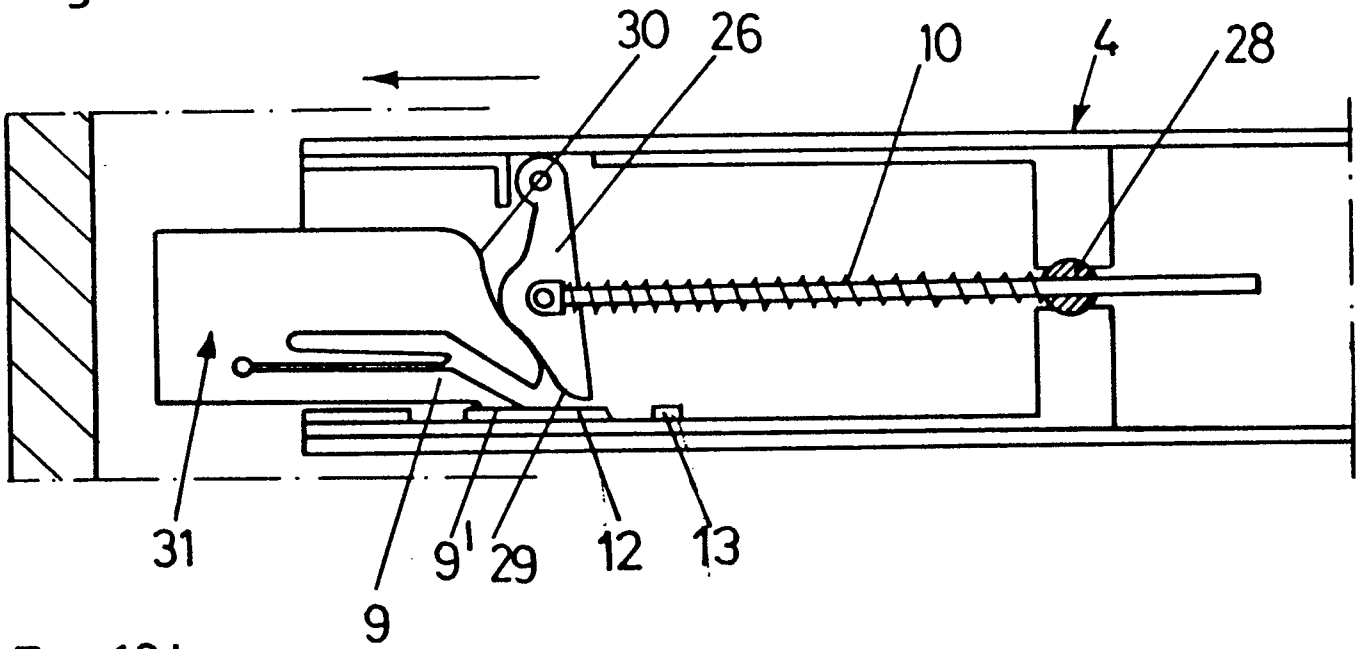
Figure 13B:
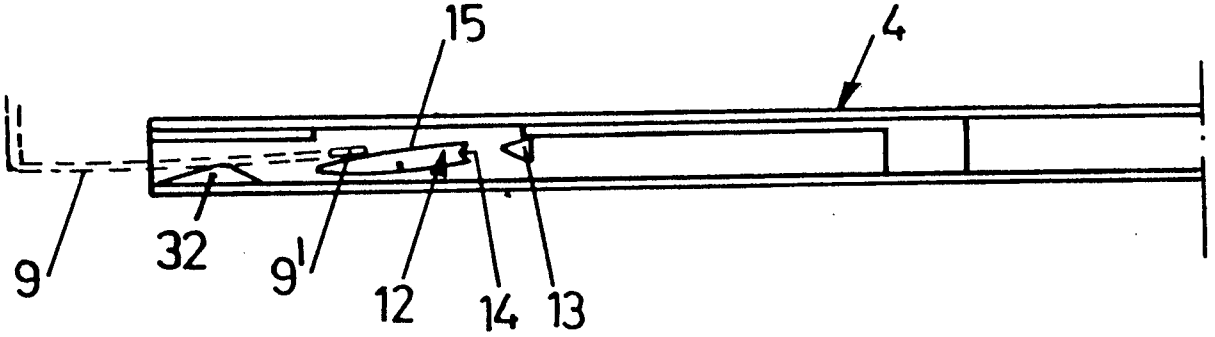

In FIGS. 12*a* and 12*b* the holding part 9 and the latch part 11 are shown fully disengaged.

Figure 14:
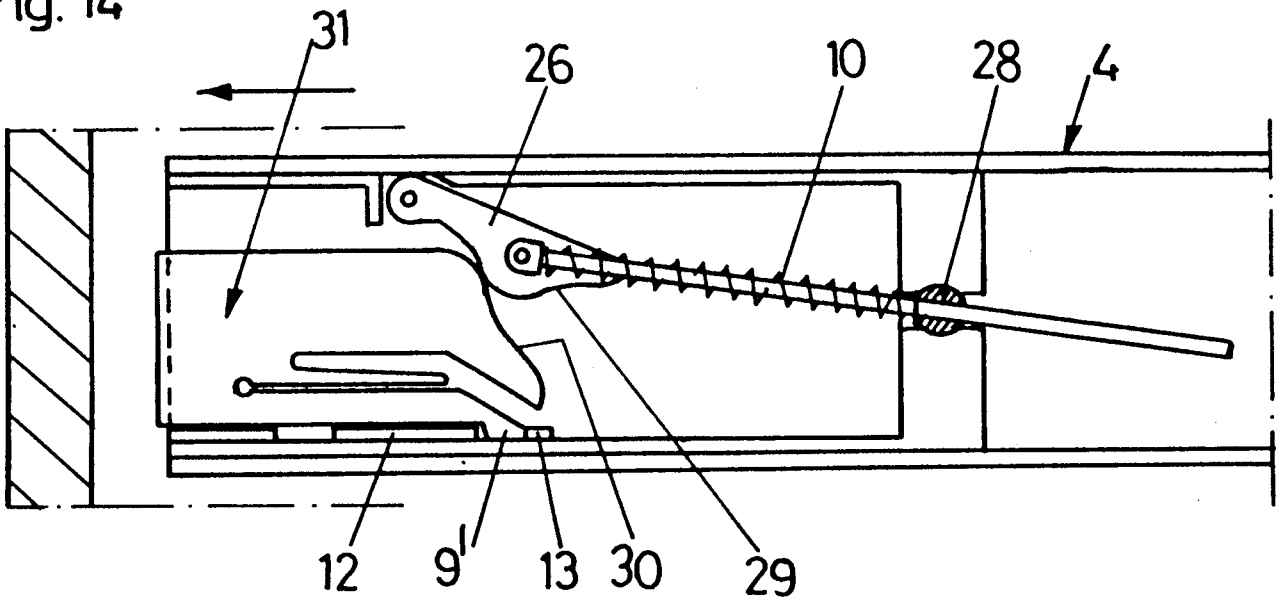
Figure 14A:
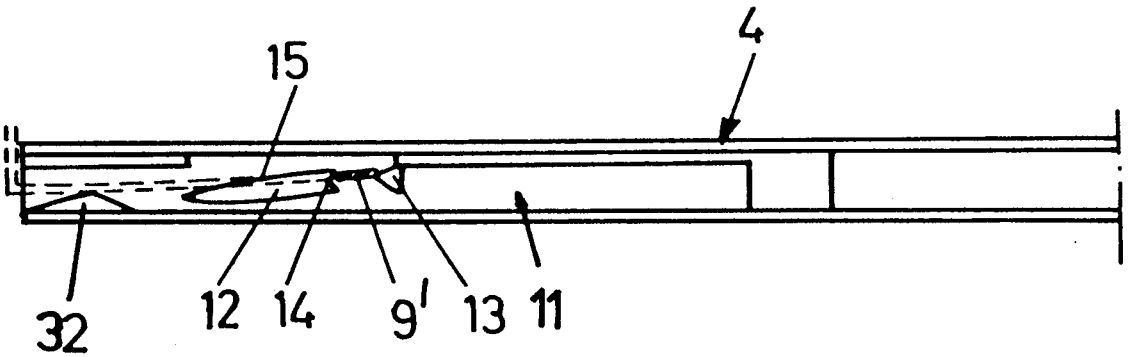
Figure 15:
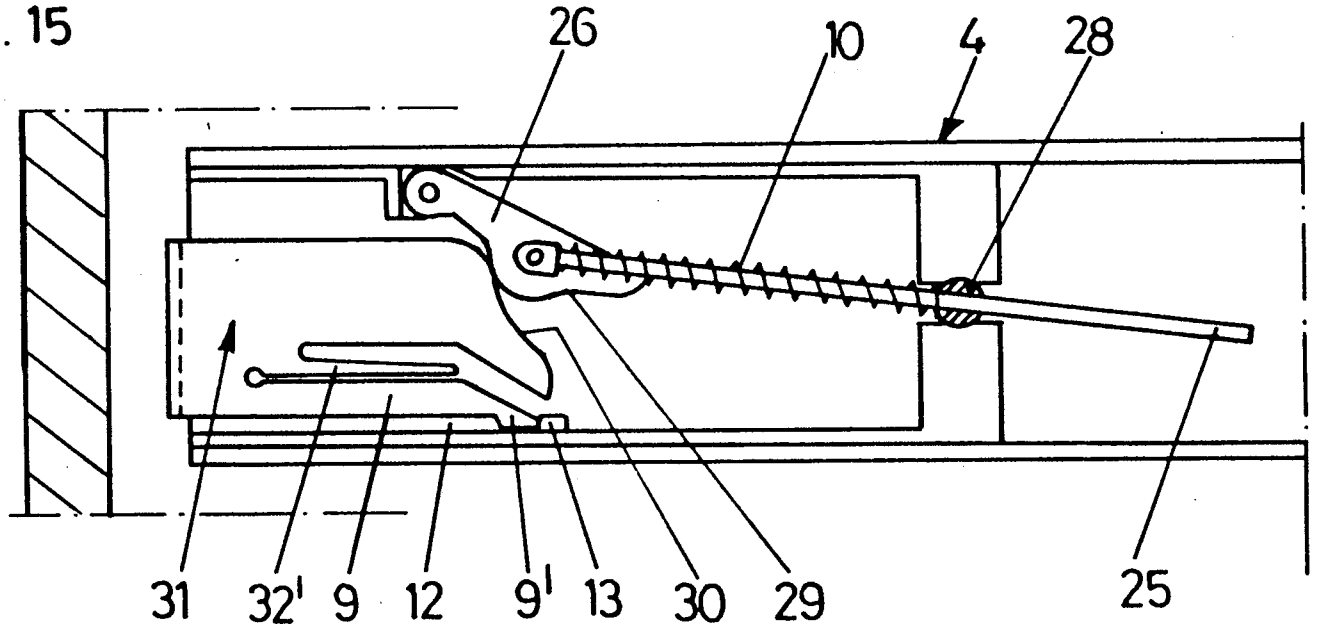
Figure 15A:
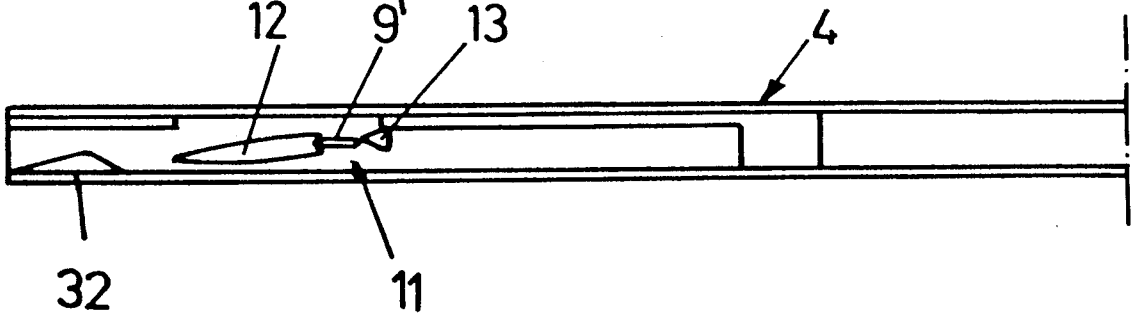

When the drawer 1 is closed by a person using the drawer, the free end 9' of holding part 9 is guided laterally along the guide track 15 of the raised area 12 (see FIGS. 13*a* and 13*b*) until the hook-shaped free end 9' engages again in the notch 14 of the raised area 12 and the drawer is locked (FIGS. 7*a* and 7*b*). FIGS. 14*a* and 14*b* show how the free end 9' of the holding part 9 is pressed into the notch 14 by the elasticity of the holding part 9 itself, after fee end 9 has passed the guide track 15. The closing device then is engaged again and the drawer 1 is locked (FIGS. 15*a* and 15*b*).

FIGS. 16 and 17 show how the holding part 9 is evaded when the drawer 1 is pulled out from the furniture body by careless handling ie. how the free end 9' of the holding part 9 bends in the plane of the hook to evade the raised are 12, thereby avoiding damage to the closing device. A spring bracket 32' which limits such evading motion of the holding part 9 is formed in the stop member 31.

I claim:

1. A closing device for use in locking a drawer in a closed position in an article of furniture, wherein the drawer is movable in opposite directions with respect to the article of furniture between the closed position and open positions, said device comprising:

a holding member for fastening to one of the drawer or the article of furniture, said holding member comprising a hook;

a latch member for fastening to the other of the article of furniture or the drawer, said latch member having engaging means to be engaged by said hook of said holding member when the drawer is in the closed position thereof;

said latch member having at least one raised area having a contour defining at least two different guide tracks for guiding said holding member, such that said holding member is guided by different of said guide tracks during opening and closing movement of the drawer relative to the article of furniture;

said holding member being bendable in opposite directions during guiding thereof by said two guide tracks; and said holding member being bendable in another direction transverse to said opposite directions, thereby providing release of said hook from said engaging means upon careless opening of the drawer.

2. A device as claimed in claim 1, wherein said engaging means comprises a notch formed in said latch member for receipt of said hook.

3. A device as claimed in claim 1, wherein said another direction in which said holding member is bendable extends within the plane of said hook.

4. A device as claimed in claim 1, wherein said latch member includes two said raised areas spaced from each other in said opposite directions of movement.

5. A device as claimed in claim 4, wherein said two raised areas comprise front and rear raised areas relative to the direction of movement of the drawer into the article of furniture, and said front raised area has a triangular configuration including a vertex directed toward said rear raised area.

6. A device as claimed in claim 1, further comprising a spring mountable between the drawer and the article of furniture for urging the drawer to an open position thereof.

7. A device as claimed in claim 6, wherein said spring is mountable on the article of furniture and has a catch member, and further comprising a driving member to be mounted on the drawer and abutted by said catch member.

8. A device as claimed in claim 7, wherein said catch member comprises a ring.

9. A device as claimed in claim 7, wherein said catch member comprises a plate.

10. A device as claimed in claim 6, wherein said spring is mountable on the drawer, and further comprising a pivot member mountable on the drawer and having a curved control member, and a stop member mountable on the article of furniture and having a curved surface, said spring acting between the drawer and said pivot member to urge said curved control member into abutment with said curved surface.

11. A device as claimed in claim 10, wherein said stop member and said hook are formed integrally.

12. In an assembly including a drawer movable in opposite directions into and out of an article of furniture between closed and open positions, and a closing device for locking said drawer with respect to said article of furniture in said closed position, the improvement wherein said closing device comprises:

a holding member fastened to one of said drawer of said the article of furniture, said holding member comprising a hook;

a latch member fastened to the other of said article of furniture or said drawer, said latch member having engaging means to be engaged by said hook of said holding member when said drawer is in the closed position thereof;

said latch member having at least one raised area having a contour defining at least two different guide tracks for guiding said holding member, such that said holding member is guided by different of said guide tracks during opening and closing movement of said drawer relative to said article of furniture;

said holding member being bendable in opposite directions during guiding thereof by said two guide tracks; and said holding member being bendable in another direction transverse to said opposite directions, thereby providing release of said hook from said engaging means upon careless opening of said drawer.

13. The improvement claimed in claim 12, wherein said engaging means comprises a notch formed in said latch member for receipt of said hook.

14. The improvement claimed in claim 12, wherein said another direction in which said holding member is bendable extends within the plane of said hook.

15. The improvement claimed in claim 12, wherein said latch member includes two said raised areas spaced from each other in said opposite directions of movement.

16. The improvement claimed in claim 15, wherein said two raised areas comprise front and rear raised areas relative to the direction of movement of said drawer into said article of furniture, and said front raised area has a triangular configuration including a vertex directed toward said rear raised area.

17. The improvement claimed in claim 12, further comprising a spring mounted between said drawer and said article of furniture for urging said drawer to an open position thereof.

18. The improvement claimed in claim 17, wherein said spring is mounted on said article of furniture and has a catch member, and further comprising a driving member to be mounted on said drawer and abutted by said catch member.

19. The improvement claimed in claim 18, wherein said catch member comprises a ring.

20. The improvement claimed in claim 18, wherein said catch member comprises a plate.

21. The improvement claimed in claim 17, wherein said spring is mounted on said drawer, and further comprising a pivot member mounted on said drawer and having a curved control member, and a stop member mounted on said article of furniture and having a curved surface, said spring acting between said drawer and said pivot member to urge said curved control member into abutment with said curved surface.

22. The improvement claimed in claim 21, wherein said stop member and said hook are formed integrally.

23. The improvement claimed in claim 21, wherein said spring and said pivot member are mounted within a side wall of said drawer.

* * * * *